US007741948B2

(12) United States Patent
Liu et al.

(10) Patent No.: US 7,741,948 B2
(45) Date of Patent: Jun. 22, 2010

(54) LAMINATED VARIABLE RESISTOR

(75) Inventors: Shih-Kwan Liu, Miaoli (TW); Hui-Ming Feng, Miaoli (TW)

(73) Assignee: Inpaq Technology Co., Ltd., Miaoli (TW)

( * ) Notice: Subject to any disclaimer, the term of this patent is extended or adjusted under 35 U.S.C. 154(b) by 36 days.

(21) Appl. No.: 11/540,606

(22) Filed: Oct. 2, 2006

(65) Prior Publication Data

US 2008/0079532 A1 Apr. 3, 2008

(51) Int. Cl.
*H01C 7/00* (2006.01)

(52) U.S. Cl. ..... 338/13; 257/536; 338/21; 338/20

(58) Field of Classification Search ..... 257/536; 338/13, 20–21
See application file for complete search history.

(56) References Cited

U.S. PATENT DOCUMENTS

2006/0220780 A1* 10/2006 Matsuoka et al. ..... 338/21
2007/0171025 A1* 7/2007 Katsumura et al. ..... 338/21

* cited by examiner

*Primary Examiner*—Cuong Q Nguyen
*Assistant Examiner*—Trang Q Tran
(74) *Attorney, Agent, or Firm*—WPAT, P.C.; Anthony King

(57) ABSTRACT

A laminated variable resistor comprises a main body, internal electrodes extending along two side edges of the main body into the main body, terminal electrodes disposed on the two ends of the main body. The mole percentage of the oxide in overlapping active regions between opposite internal electrodes is reduced and the reduced portion is replaced by a metal selected from gold (Au), silver (Ag), palladium (Pd), platinum (Pt), rhodium (Rh), or the alloy of any two of such metals.

3 Claims, 5 Drawing Sheets

LAMINATED VARIABLE RESISTOR

BACKGROUND OF THE INVENTION

1. Field of the Invention

The present invention relates to a laminated variable resistor, and more particularly to a laminated variable resistor with an active region of a metal phase.

2. Description of the Prior Art

The conventional laminated variable resistor, as shown in FIGS. 1A and 1B, includes a main body 10, internal electrodes 101, 102, 103 extending along two side edges of the main body into the main body 10, terminal electrodes 20 disposed on two ends of the main body, and a cover layer 30 disposed on the top surface of the main body. The main body mainly includes zinc oxide (ZnO) of more than 90 mole % mixed with a metal oxide of less than 10 mole % as an additive, wherein the metal constituting the metal oxide includes cobalt (Co), manganese (Mn), bismuth (Bi), stibium (Sb), chrome (Cr), nickel (Ni), titanium (Ti), stannum (Sn), lanthanum (La), neodymium (Nd), praseodymium (Pr), barium (Ba), magnesium (Mg), cerium (Ce), and boron (B). The aluminum nitrate ($Al_2(NO_3)_X$), glass, silicon dioxide ($SiO_2$) are used as a flux, and a metal selected from gold (Au), silver (Ag), palladium (Pd), platinum (Pt), rhodium (Rh), or the alloy of any two of such metals is used for the internal electrodes 101, etc.

The overlapping regions A, B, C between the opposite internal electrodes 101 and 102, 103 and 104 of the above conventional laminated variable resistor are "active regions" which function as a variable resistor and also have a characteristic of capacitor. In the structure of the active region shown in FIG. 2, zinc oxide (ZnO) grains 1001, are densely scattered between the overlapping regions of the internal electrodes 101 and 102, 102 and 103, 103 and 104, and the grain boundary 1002 in the periphery of the grains are filled with the oxide of a metal selected from cobalt (Co), manganese (Mn), bismuth (Bi), stibium (Sb), chrome (Cr), nickel (Ni), titanium (Ti), stannum (Sn), lanthanum (La), neodymium (Nd), praseodymium (Pr), barium (Ba), magnesium (Mg), cerium (Ce), boron (B), and rhodium (Rh).

According to the above description, the material in the active regions of the conventional laminated variable resistor is a metal oxide or a combination of a metal oxide and glass without having any metal phase, so that the breakdown voltage is high. Further, when the conventional laminated variable resistor is fabricated to be thin, it can only bear the current of low intensity. If the current is high, or an inrush current or a spark exists, the conventional laminated variable resistor may be burnt out. Moreover, the conventional laminated variable resistor has the disadvantages that the equipment for manufacturing the above conventional laminated variable resistor is expensive, and the working staff must be well trained. To train the staff takes a lot of time and is difficult.

In view of the above disadvantages of the conventional laminated variable resistor, the inventors did research for a long time and proposed an improvement directed at eliminating the above disadvantages.

SUMMARY OF THE INVENTION

Accordingly, the present invention is directed at providing a laminated variable resistor. According to the laminated variable resistor of the present invention, the mole percentages of the oxides in the active regions are reduced, and the reduced portions are replaced by a metal selected from gold (Au), silver (Ag), palladium (Pd), platinum (Pt), rhodium (Rh), or an alloy of any two of such metals. The laminated variable resistor, which has the characteristic of a variable resistor, can also be fabricated by a laminating process.

According to the laminated variable resistor of the present invention, since the active region has the metal phase, the breakdown voltage can be reduced, and the intensity is thus enhanced, which is another object of the present invention.

According to the laminated variable resistor of the present invention, the equipment for manufacturing the conventional laminated variable resistor can be omitted, thereby significantly reducing the cost of the equipment and the cost of training working staff, and improving the yield, which is still another object of the present invention.

The detailed structure, application principle, function and efficacy of the present invention are apparent from the following description accompanied with figures.

DETAILED DESCRIPTION

Figure 1A:
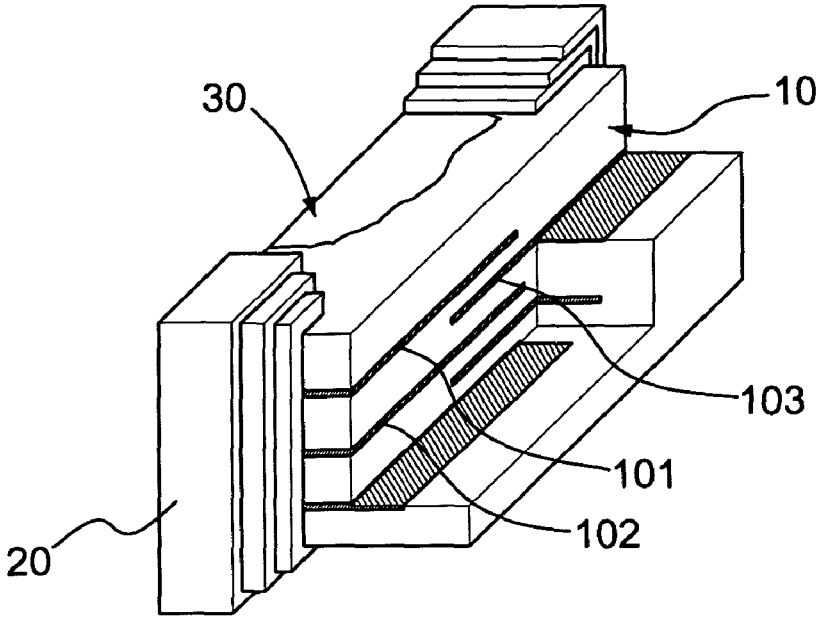
FIG. 1A is a cut-away pictorial view of a conventional laminated variable resistor.
Figure 1B:
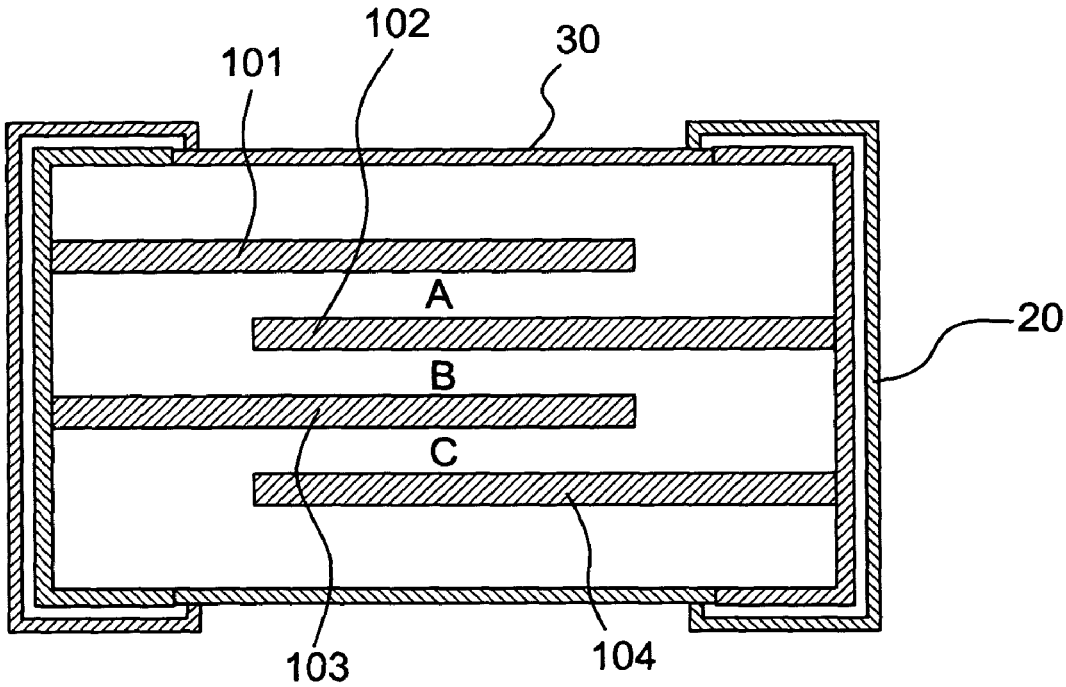
FIG. 1B is a schematic view of active regions of the conventional laminated variable resistor.
Figure 2:
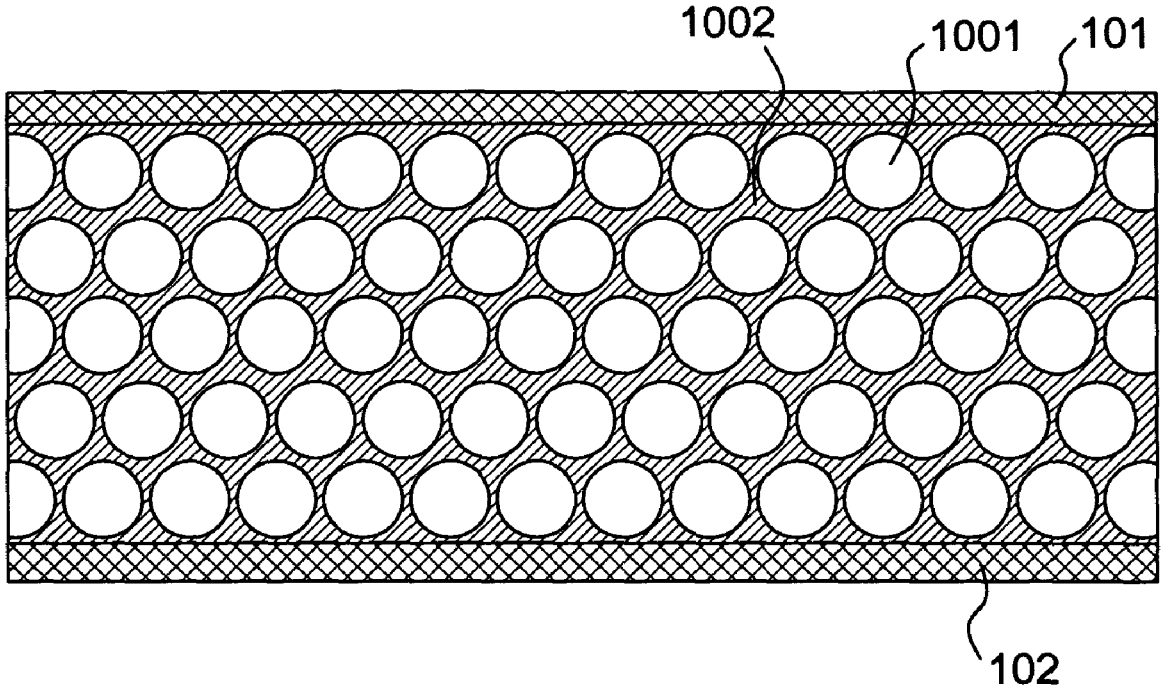
FIG. 2 is a schematic view of an active region of the conventional laminated variable resistor.

FIGS. 1A, 1B, and 2 show the structure and disadvantages of a conventional laminated variable resistor, which are described above and will not be described here again.

Figure 3A:
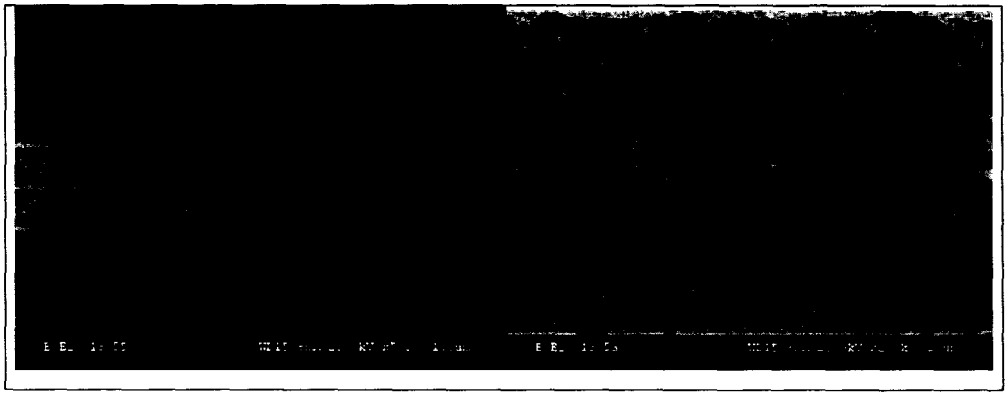
FIG. 3A is a micrograph of active regions of the laminated variable resistor of the present invention.
Figure 3B:
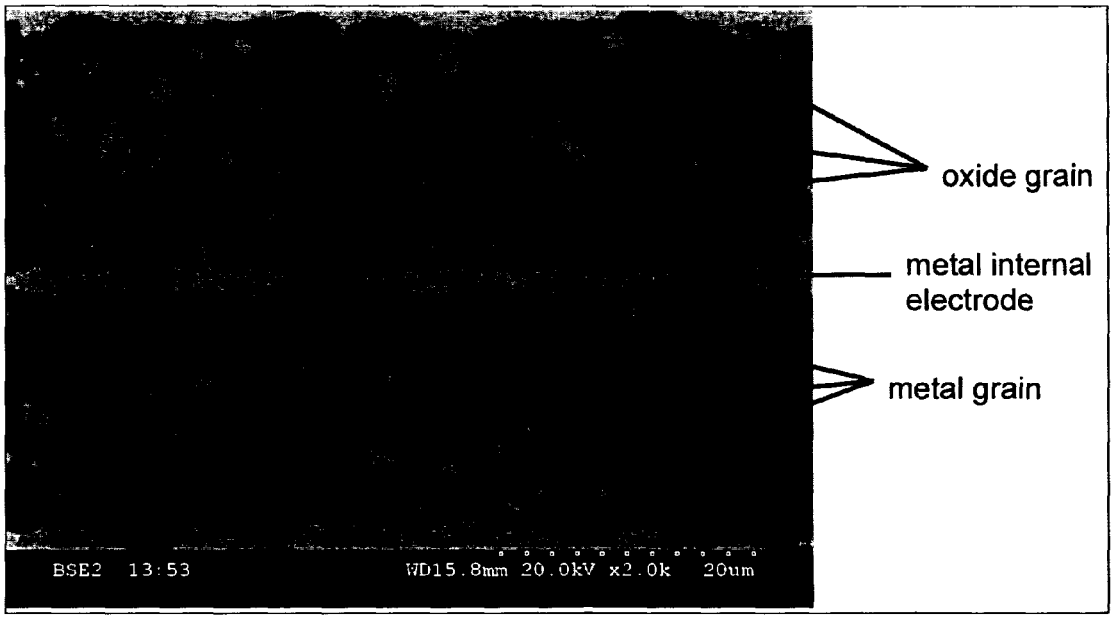
FIG. 3B is an enlarged micrograph of the active regions of the laminated variable resistor of the present invention.
Figure 4:
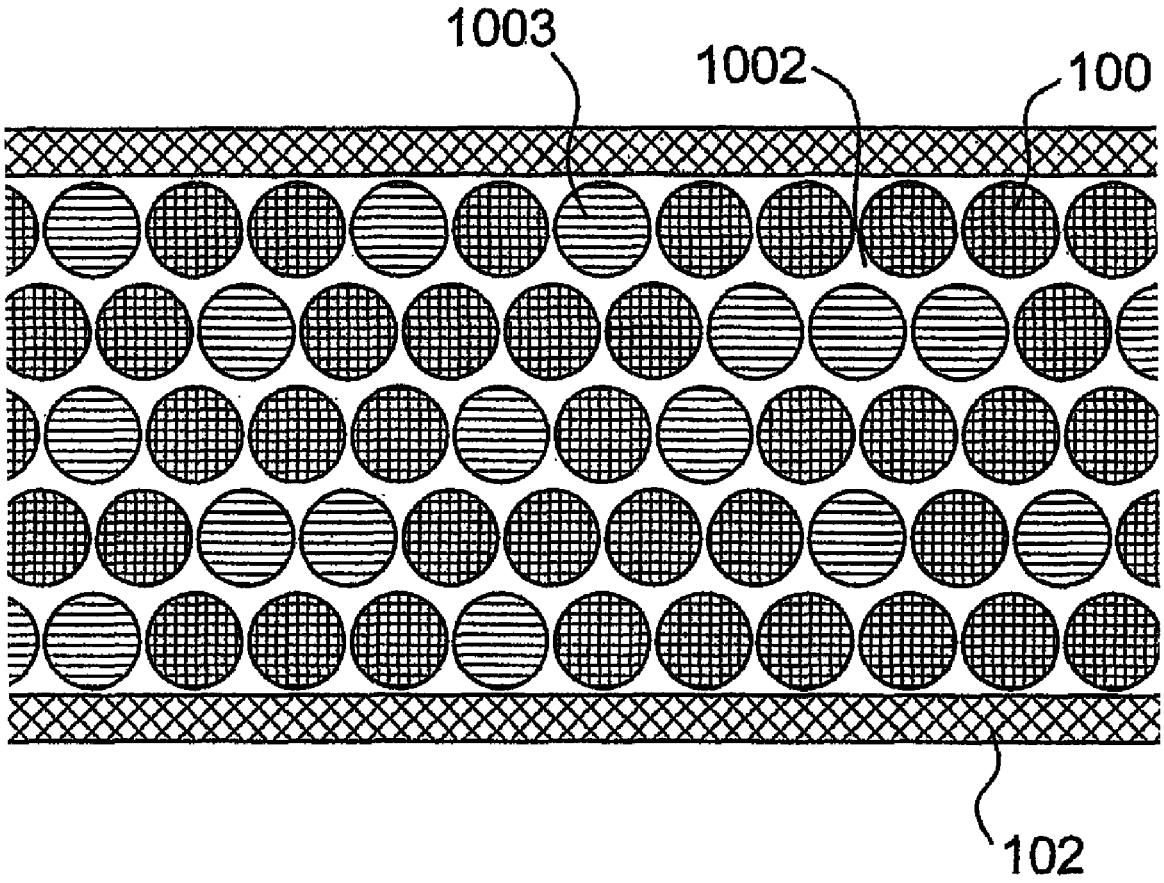
FIG. 4 is a schematic view of the active regions of the laminated variable resistor of the present invention.

FIGS. 3A and 3B show a laminated variable resistor of the present invention, wherein the mole percentages of oxides in active regions are reduced, and the reduced portions are replaced by a metal (1003 in FIG. 4) selected from gold (Au), silver (Ag), palladium (Pd), platinum (Pt), rhodium (Rh), or the alloy of any two of such metals. Using the laminating process for manufacturing the laminated variable resistor shown in FIGS. 1A and 1B, the laminated variable resistor having the characteristic of a variable resistor is sintered at temperatures of 900° C. to 1400° C. to become a dense sintered body, such that the metal phase in the active regions becomes a structure combined with "metal oxide grain," "metal grain" and little or none of "glass." Thus, the zinc oxide (ZnO) grains are reduced, as shown in the schematic view of FIG. 4.

Embodiment

Figure 5:
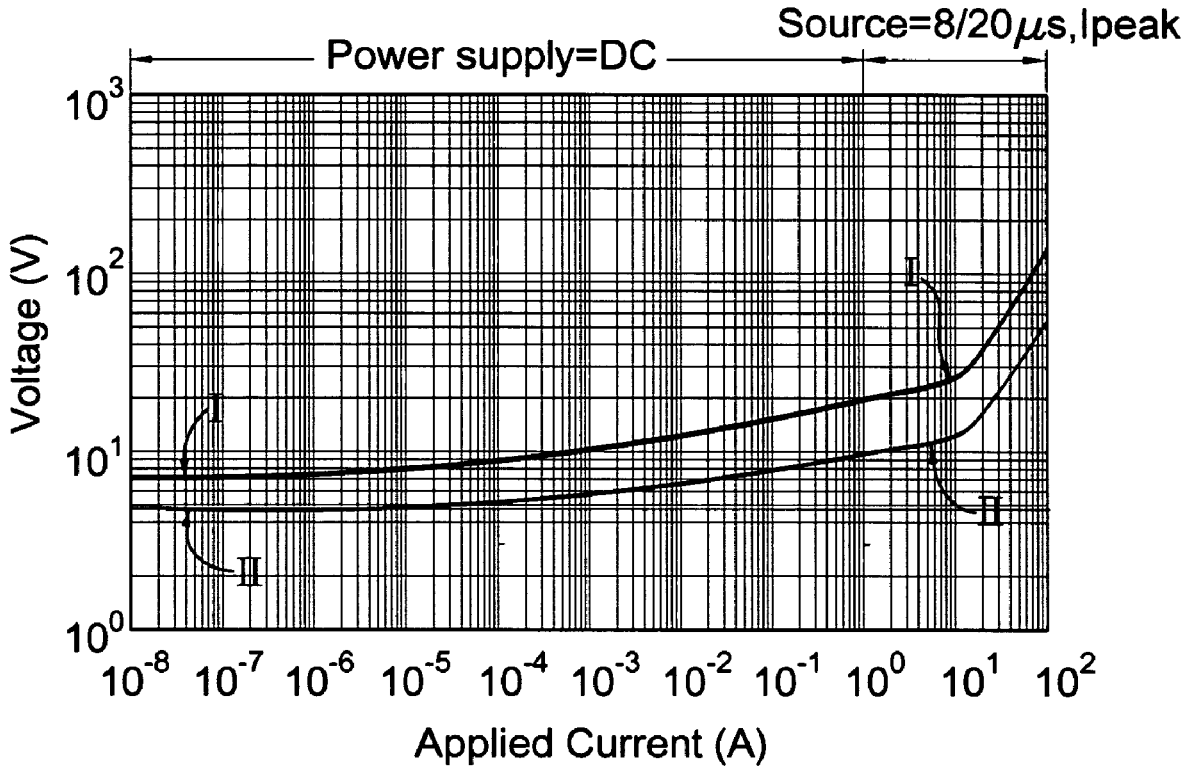
FIG. 5 shows a current-voltage characteristic curve of the conventional laminated variable resistor versus a current-voltage characteristic curve of the laminated variable resistor of the present invention.

The laminated variable resistor is formed of zinc oxide (ZnO) of 92.89 mole %, cobalt oxide ($Co_3O_4$) of 0.34 mole %, manganese oxide ($Mn_3O_4$) of 0.48 mole %, chromium trioxide ($Cr_2O_3$) of 0.29 mole %, antimony trioxide ($Sb_2O_3$) of 1.17 mole %, nickel oxide (NiO) of 0.78 mole %, praseodymium oxide ($Pr_6O_{11}$) of 0.08 mole %, 70/30 silver-palladium (Ag/Pd) alloy (consisting of 70 weight percent Ag and 30 weight percent Pd) of 3.96 mole % by using the laminating process, and the current-voltage characteristic curve thereof is curve II shown in FIG. 5.

COMPARATIVE EXAMPLE

The conventional laminated variable resistor is formed of zinc oxide (ZnO) of 96.32 mole %, bismuth trioxide ($Bi_2O_3$) of 0.51 mole %, cobalt oxide ($CO_3O_4$) of 0.35 mole %, manganese oxide ($Mn_3O_4$) of 0.51 mole %, chromium trioxide ($Cr_2O_3$) of 0.30 mole %, antimony trioxide ($Sb_2O_3$) of 1.21 mole %, nickel oxide (NiO) of 0.81 mole %, and the current-voltage characteristic curve thereof is curve I shown in FIG. 5.

Compared with the comparative example, the material of the embodiment has a low cost and the fabricated laminated variable resistor still has the characteristics of a variable resistor. Further, due to the Ag—Pd alloy, the intensity of the material of the embodiment is greatly improved.

In view of the above, the laminated variable resistor of the present invention has the efficacies including a high intensity, low breakdown voltage and simple process, which can overcome the drawbacks of the conventional laminated variable resistor.

The invention may be modified in many ways. Such modifications should not be regarded as a departure from the spirit and scope of the invention, and all such modifications would be obvious to one skilled in the art and fall within the scope of the following claims.

What is claimed is:

1. A laminated variable resistor, comprising:

a main body, including a plurality of internal electrodes respectively extending along two side edges of the main body into the main body, so as to form an overlapping region where one of the internal electrodes overlaps an adjacent electrode;

two terminal electrodes, disposed on two ends of the main body respectively;

wherein the overlapping region includes at least a metal oxide grain and a metal grain.

2. The laminated variable resistor as claimed in claim 1, wherein the metal grain is selected from gold (Au), silver (Ag), palladium (Pd), platinum (Pt), and rhodium (Rh).

3. The laminated variable resistor as claimed in claim 1, wherein the metal grain is an alloy of any two of the metals gold (Au), silver (Ag), palladium (Pd), platinum (Pt), and rhodium (Rh).

* * * * *